US005921757A

United States Patent [19]

Tsutsui et al.

[11] Patent Number: 5,921,757

[45] Date of Patent: Jul. 13, 1999

[54] PIEZOELECTRIC FAN

[75] Inventors: Toshihiro Tsutsui; Keiichirou Takatou, both of Wako, Japan

[73] Assignee: Honda Giken Kogyo Kabushiki Kaisha, Tokyo, Japan

[21] Appl. No.: 08/857,856

[22] Filed: May 19, 1997

[30] Foreign Application Priority Data

May 27, 1996 [JP] Japan ..... 8-132312

[51] Int. Cl.[6] ..... F04B 35/04

[52] U.S. Cl. ..... 417/410.2; 417/436

[58] Field of Search ..... 417/410.2, 436

[56] References Cited

U.S. PATENT DOCUMENTS

| | | | |
|---|---|---|---|
| 2,611,321 | 9/1952 | Shafer | 417/436 |
| 4,780,062 | 10/1988 | Yamada et al. | 417/410.2 |
| 4,923,000 | 5/1990 | Nelson | 417/410.2 |

FOREIGN PATENT DOCUMENTS 63-140660 9/1988 Japan .

*Primary Examiner*—Charles G. Freay

*Attorney, Agent, or Firm*—Merchant, Gould, Smith, Edell, Welter & Schmidt, P.A.

[57] ABSTRACT

A piezoelectric fan comprises at least one piezoelectric element having a rectangular piezoelectric plate of large aspect ratio, made from a piezoelectric material, and conductive metal layers provided on both surfaces of the piezoelectric plate. At least one of the conductive metal layers has a plurality of reinforcing ribs extending parallel to the long side of the piezoelectric element and formed integrally with the conductive metal layers or as a separate member collectively. The reinforcing ribs increase the long side direction rigidity of the piezoelectric element. As a result, the long side direction or lateral mode resonance of the piezoelectric element can be suppressed, thus increasing the blow efficiency of the piezoelectric fan.

16 Claims, 14 Drawing Sheets

MATERIAL : ALUMINUM FOIL (t=100 μm)

R=B/L : ASPECT RATIO
$f_0$ : NATURAL FREQUENCIES
M : DEGREE OF DISPLACEMENT

| CASES | 1 | 2 | 3 | 4 | 5 | 6 | 7 |
|---|---|---|---|---|---|---|---|
| Lmm | 10 | 10 | 10 | 10 | 10 | 10 | 10 |
| Bmm | 5 | 10 | 15 | 20 | 30 | 35 | 40 |
| R=B/L | 0.5 | 1.0 | 1.5 | 2.0 | 3.0 | 3.5 | 4.0 |
| LONGITUDINAL MODE | $f_0$=31.6Hz M=325 | $f_0$=34.5Hz M=776 | $f_0$=33.6Hz M=199 | $f_0$=34.7Hz M=551 | $f_0$=34.7Hz M=448 | $f_0$=34.8Hz M=414 | $f_0$=34.9Hz M=386 |
| 1st LATERAL MODE | | $f_0$=84.0Hz M=1120 | $f_0$=57.9Hz M=296 | $f_0$=52.9Hz M=826 | $f_0$=43.6Hz M=660 | $f_0$=41.4Hz M=604 | $f_0$=39.9Hz M=558 |
| 2nd LATERAL MODE | | | | $f_0$=100.0Hz M=873 | $f_0$=67.4Hz M=730 | $f_0$=59.7Hz M=671 | $f_0$=54.3Hz M=620 |

PIEZOELECTRIC FAN

BACKGROUND OF THE INVENTION

1. Field of the Invention

The present invention relates to a piezoelectric fan employing a piezoelectric element which exhibits expansion and contraction actions when a voltage is applied thereacross. The present invention also relates to a blow apparatus employing such a piezoelectric fan.

2. Description of the Related Art

Technology that can be applied to a piezoelectric fan is known from, for example, Japanese Utility Model Kokai (Laid-Open) Publication No. SHO 63-140660 entitled "Piezoelectric Actuator". As described in the publication, the piezoelectric actuator is comprised of a metallic intermediate plate electrode having a multiplicity of polygonal apertures extending therethrough, and piezoelectric elements bonded to both surfaces of the intermediate plate electrode.

Reference is made to FIG. 14 hereof which illustrates the principle of a conventional piezoelectric fan employing a piezoelectric element.

Piezoelectric fan 100 is comprised of a square piezoelectric element 101 fixed at one end to a stationary member 102. The piezoelectric element 101 is comprised of a piezoelectric plate 103 and electrodes 104, 104 provided on both surfaces of the piezoelectric plate 103. Extending through the electrodes 104, 104 is a lead 105 connected to an alternating current (AC) source 106. In the piezoelectric fan 100, when an AC voltage is applied across the two electrodes 104, 104, the piezoelectric plate 103 vibrates in directions shown by arrows "a", "a" and generates a wind blowing in a direction of arrow "b". This is the principle of the piezoelectric fan.

With a view to increase wind generating or blow efficiency of piezoelectric fans, the present inventors have investigated various rectangular piezoelectric fans, which are long lengthwise and sidewise.

Reference is now had to FIG. 1A and FIG. 1B showing the manners in which winds are generated by the lengthwise- and sidewise-long piezoelectric fans.

In FIG. 1A, assume that the piezoelectric fan E has a transverse length B and a longitudinal length L, and that the ratio between these is an aspect ratio R. Then, the aspect ratio can be represented by R=B/L.

Stated otherwise, FIG. 1A shows the piezoelectric fan E of small aspect ratio wherein the lateral length B is shorter than the longitudinal length L. As the piezoelectric fan E vibrates in directions of arrows (1), (1), winds blowing in a desired or blow direction of arrow (2) and directions of arrows (3), (3) are generated. Thus, to utilized the piezoelectric fan E of small aspect ratio, it is necessary to install a wall on each side of the fan E since the winds escaping sideways as at (3), (3) are substantial in amount.

FIG. 1B shows the piezoelectric fan F of large aspect ratio wherein the lateral length B is longer than the longitudinal length L. When the piezoelectric fan F vibrates in directions of arrows (4), (4), it generates winds blowing in a desired (blow) direction of arrow (5) and directions of arrows (6), (6). As can be appreciated, in the piezoelectric fan F of large aspect ratio, the wind blowing in the desired or blow direction of arrow (5) is larger in amount than the winds escaping sideways as at (6), (6), which escaping winds are less than those in the piezoelectric fan E of small aspect ratio. In this respect, the piezoelectric fan F of large aspect ratio is more desirable. However, piezoelectric fan F of large aspect ratio encounters problems as described hereinbelow.

Shown in FIG. 2 are lateral and longitudinal mode vibrations of the piezoelectric fan of large aspect ratio. This fan F has a lateral length B and a longitudinal length L. Reference character Vb represents lateral mode vibrations while Vl represents longitudinal mode vibrations. In the piezoelectric fan of large aspect ratio, the lateral mode vibrations Vb are liable to cancel each other, whereby wind generation efficiency is deteriorated.

Further reference is made to FIG. 3 which lists vibration mode analysis data relative to resonant (natural) frequencies $f_0$ and rates of displacement M generated in a longitudinal mode, a first lateral mode and a second lateral mode at various aspect ratios R. When $R=B/L \geqq 3.0$, resonant frequencies $f_0$ of longitudinal mode and first lateral mode are within a difference of 25% and rather close to each other. When $R=B/L \leqq 1.5$, resonant frequencies $f_0$ of the longitudinal mode and first lateral mode are more than 1.7 times away. Accordingly, it is considered that resonance of the first lateral mode become significant when $R=B/L \geqq 3.0$.

Through these studies, the inventors have discovered that it is possible to provide piezoelectric fans with increased wind generation efficiency by employing piezoelectric fans of large aspect ratio (cases 5–7 in FIG. 3) capable of generating more winds blowing in a desired or blow direction while suppressing the lateral mode resonance. This lead to the present invention.

SUMMARY OF THE INVENTION

According to one aspect of the present invention, there is provided a piezoelectric fan comprising at least one piezoelectric element which is composed of a rectangular thin plate of piezoelectric material, and conductive metal layers disposed as electrodes on both surfaces of the thin plate. One of the conductive metal layers has a plurality of reinforcing ribs extending parallel to the long side of the piezoelectric element. Since the long side direction rigidity of the piezoelectric element is increased by the reinforcing ribs, the lateral mode resonance of the piezoelectric fan is suppressed, whereby the blow efficiency of the fan is increased. The piezoelectric element desirably has an aspect ratio of 3.0 or over.

In a preferred form, the reinforcing ribs may be comprised of a first group of reinforcing ribs and a second group of reinforcing ribs separated by a trunk portion extending perpendicularly to a stationary member at a central part of the conductive metal layers.

The piezoelectric element may be comprised of two piezoelectric elements bonded together through a bond layer to thereby provide a dual-layered piezoelectric element, at least one of which piezoelectric elements is provided with the reinforcing ribs on one of the conductive metal layers thereof. This arrangement is desirable in that it generates more wind greater in amount than that generated by the aforementioned single-layer piezoelectric element.

Desirably, the reinforcing ribs may be formed integrally with the conductive metal layers. Alternatively, the ribs may be formed from a separate member independent of the conductive metal layers. The structurally independent reinforcing ribs may be formed from conductive metals or synthetic resins.

According to another aspect of the present invention, there is provided a piezoelectric fan unit comprising a stiffener as a substrate and a plurality of piezoelectric fans disposed on a surface of the stiffener in a row at a predetermined interval. Each piezoelectric fan is comprised of at least one piezoelectric element bonded onto plural reinforcing ribs formed on the stiffener to extend parallel to the long side of the piezoelectric element. The piezoelectric element is composed of a generally rectangular thin plate of piezoelectric material, and conductive metal layers as electrodes bonded to both surfaces of the thin plate. By virtue of the reinforcing ribs provided on the stiffener or substrate, the long side direction rigidity of the piezoelectric element is increased, whereby the blow efficiency of the fan unit is increased.

The reinforcing ribs are formed by providing the substrate with channel-shaped slits to thereby provided a plurality of cutouts and rectangular holes enclosed by the slits and extending parallel to the long side of the piezoelectric element. This arrangement is desirable in that it enables easy manufacture of the substrate.

According to a further aspect of the present invention, there is provided a blow apparatus comprising fan body having a plurality of piezoelectric fan units arranged in rows by means of spacers. Since the fan body has a multiplicity of the above-described piezoelectric fans of high blow efficiency, it can generates a lot of winds.

BRIEF DESCRIPTION OF THE DRAWINGS

Preferred embodiments of the present invention will be described below with reference to the accompanying drawings, in which.

DETAILED DESCRIPTION OF THE PREFERRED EMBODIMENT

The following description is merely exemplary in nature and is in no way intended to limit the invention or its application or uses.

Figure 1A:
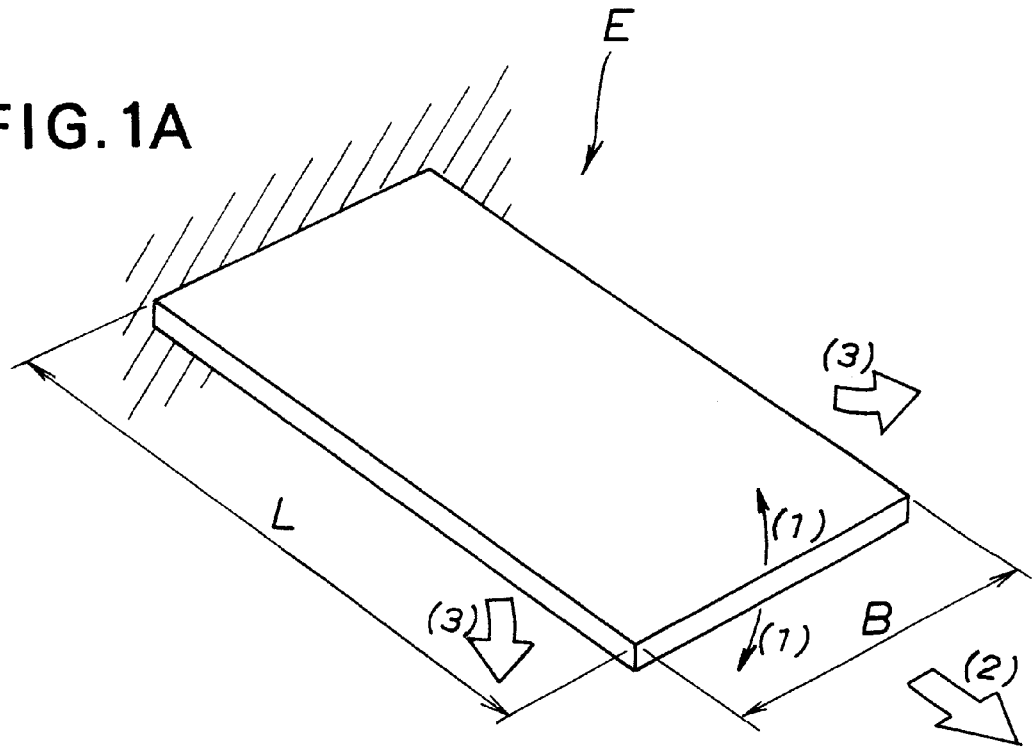
FIG. 1A and FIG. 1B are schematic views showing how winds are generated by piezoelectric fans having different aspect ratios.
Figure 1B:
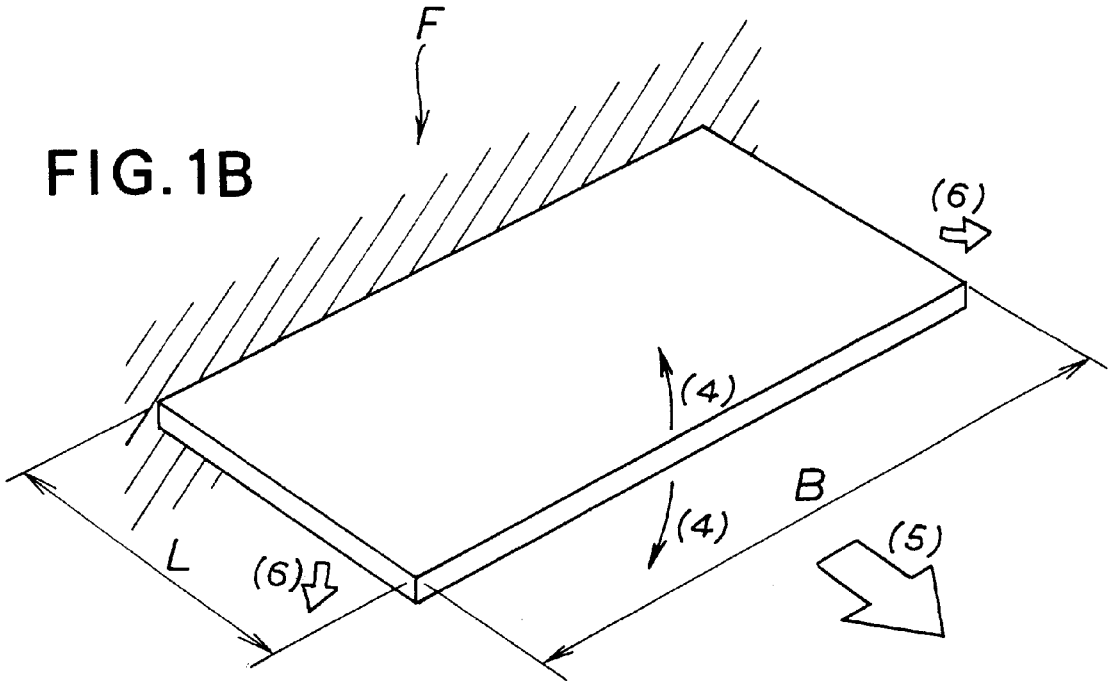
Figure 2:
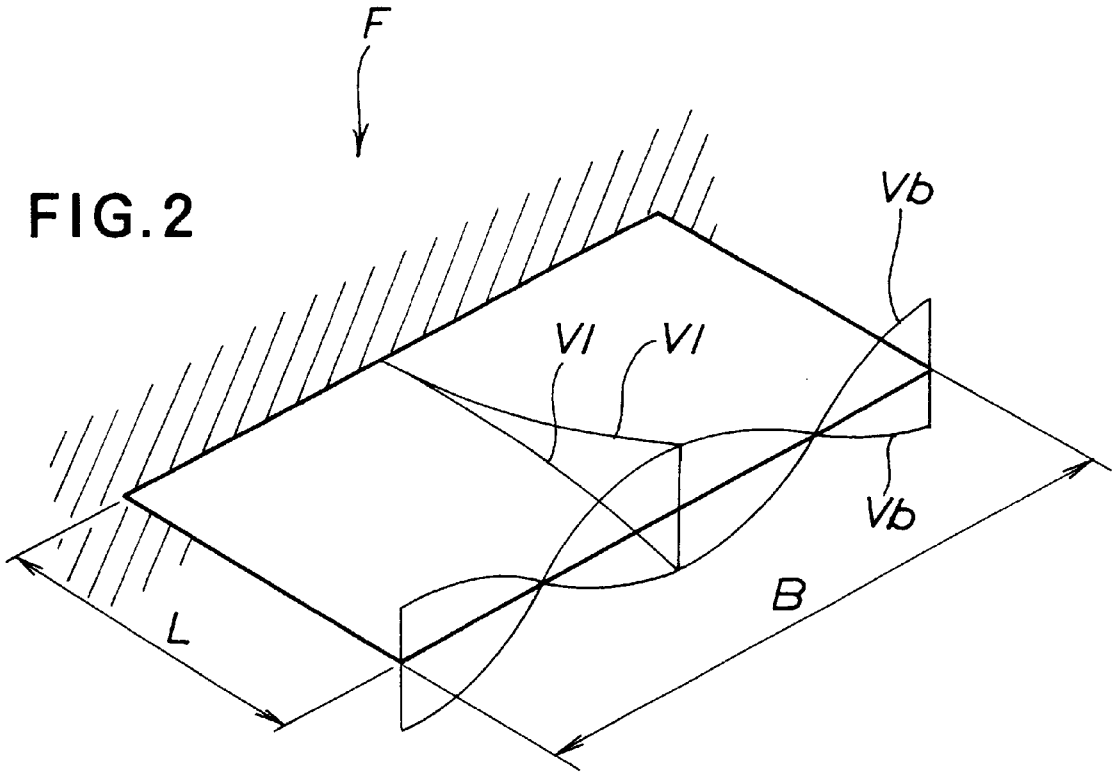
FIG. 2 is a schematic view illustrating the lateral mode vibrations of a piezoelectric fan of large aspect ratio.
Figure 3:
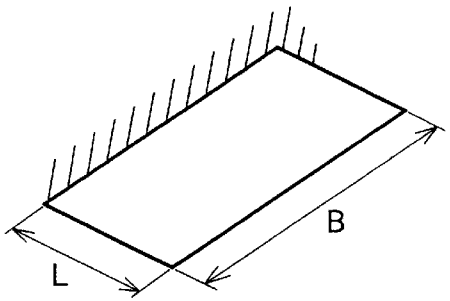
FIG. 3 is a table of vibration mode analysis data relative to resonant frequencies and rates of displacement generated in a longitudinal mode, a first lateral mode and a second lateral mode at various aspect ratios.
Figure 4A:
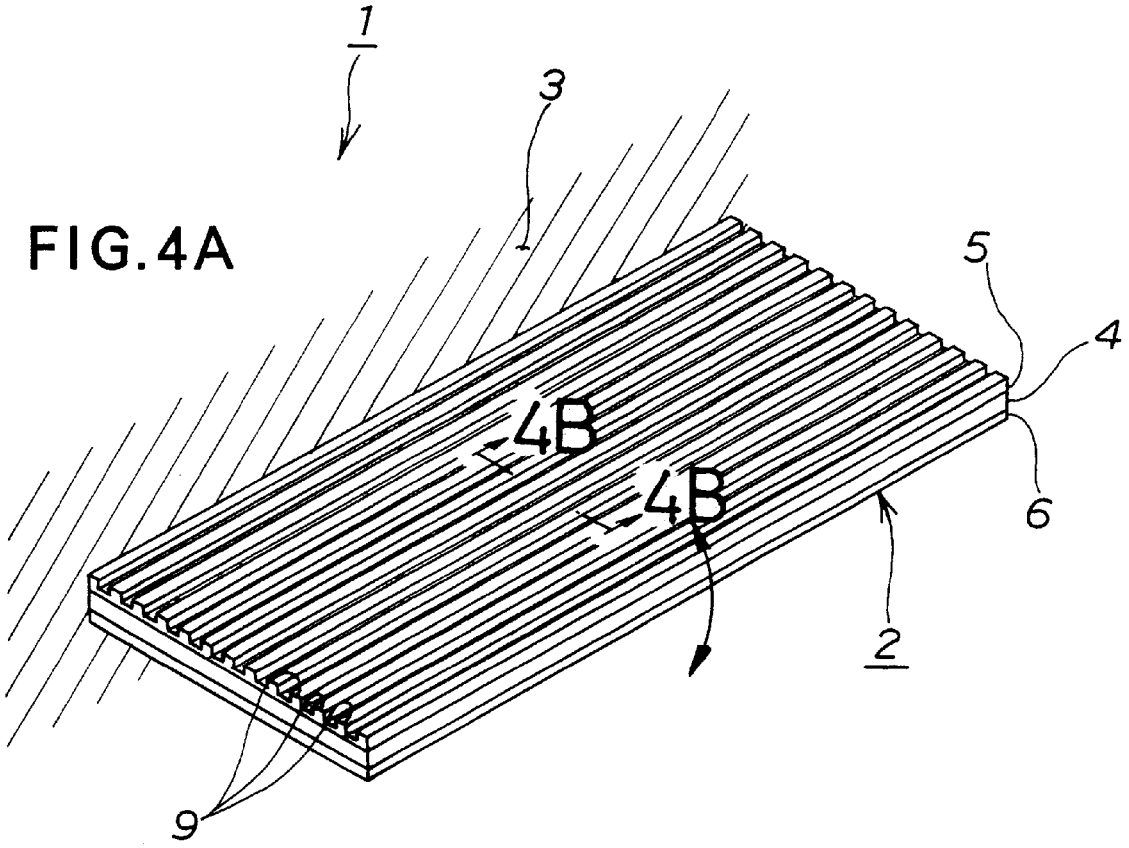
FIG. 4A is a perspective view illustrating a piezoelectric fan according to a first embodiment of the present invention.

Reference is made to FIG. 4A which schematically shows a piezoelectric fan according to a first embodiment of the present invention. The piezoelectric fan 1 has a piezoelectric element 2 fixed at one end to a stationary member 3.

Figure 4B:
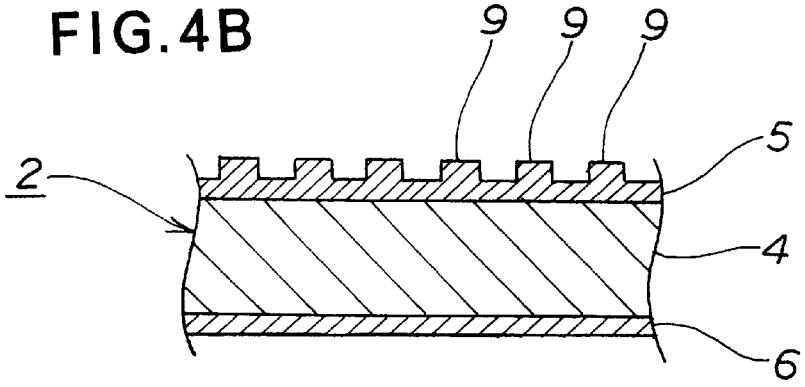
FIG. 4B is a cross-sectional view taken along line 4B—4B of FIG. 4A.

Turning to FIG. 4B, the piezoelectric element 2 is comprised of a relatively thin piezoelectric plate 4 made from a piezoelectric material such as polyvinylidene fluoride (PVDF), and electrodes 5, 6 of conductive metal layers disposed on upper and lower surfaces of the piezoelectric plate 4. At least one electrode 5 has a plurality of reinforcing ribs 9 extending longitudinally of the element 2. The reinforcing ribs 9 of the embodiment being described are formed integrally with the respective conductive metal layer acting as an electrode.

Piezoelectric fan 1 of the described embodiment has a large aspect ratio and employs the piezoelectric element 2 with the single-layered piezoelectric plate 4.

When an AC voltage is applied across the electrodes 5, 6, the piezoelectric plate 4 vibrates by performing expansion and contraction actions to thereby generate a wind directed oppositely from the stationary member 3. At this time, the lateral mode resonance can be suppressed by the reinforcing ribs 9, whereby wind generation efficiency of the piezoelectric fan can be increased.

Figure 5A:
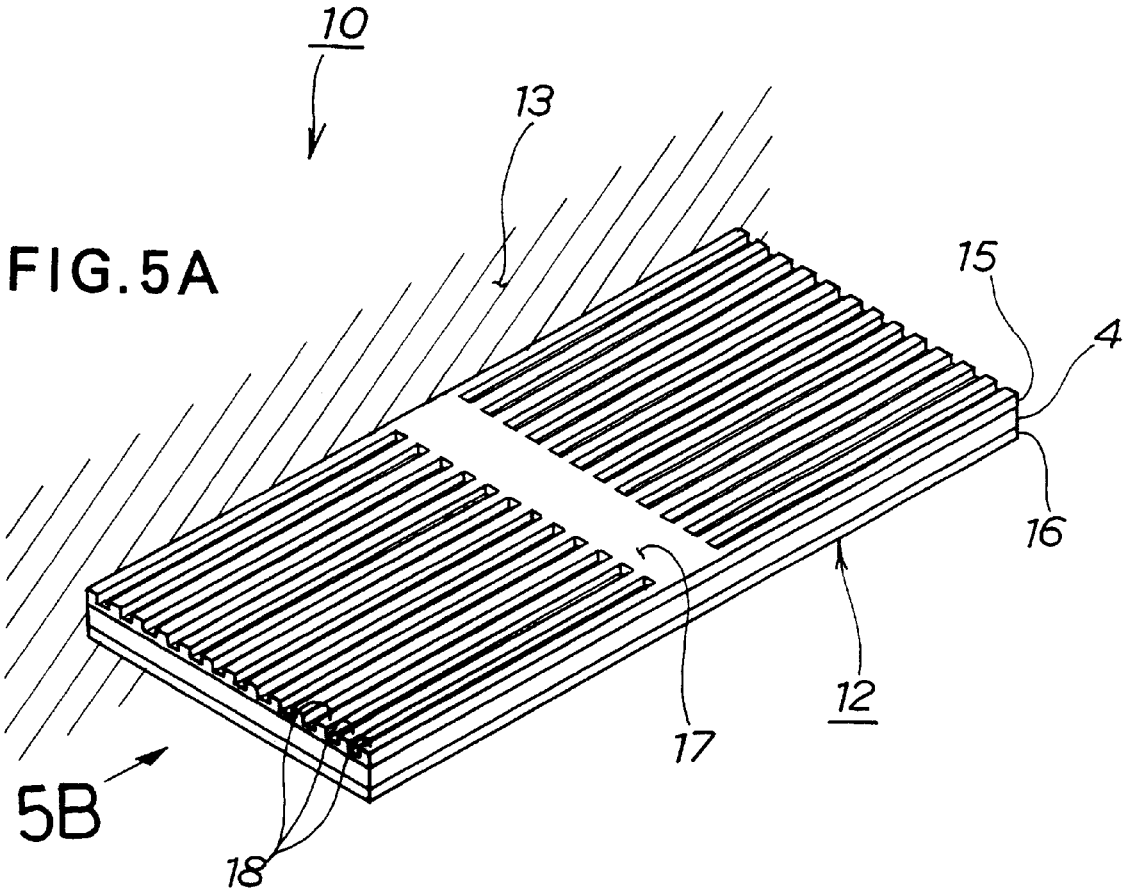
FIG. 5A is a perspective view illustrating a piezoelectric fan according to a second embodiment of the present invention.

Turning to FIG. 5A, there is shown a piezoelectric fan 10 according to a second embodiment of the present invention. The piezoelectric fan 10 has a piezoelectric element 12 fixed at one end to a stationary member 13.

Figure 5B:
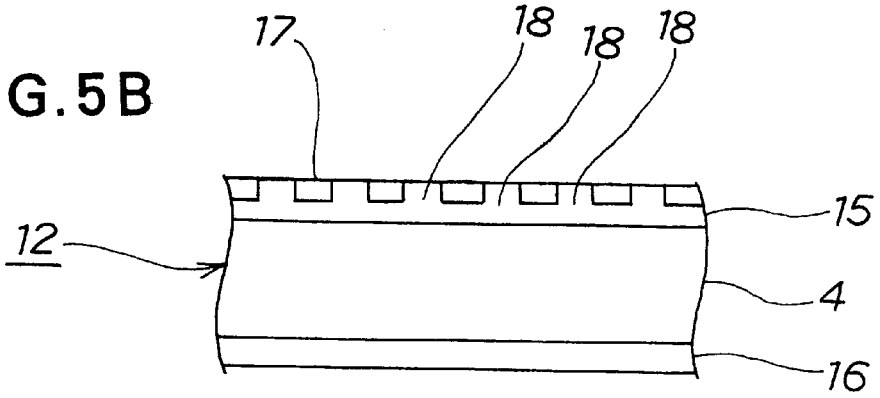
FIG. 5B is a side elevational view of the piezoelectric fan of FIG. 5A as seen in a direction of arrow 5B.

As shown in FIG. 5B, the piezoelectric element 12 is comprised of a relatively thin piezoelectric plate 4 made from a piezoelectric material such as PVDF, and electrodes 15, 16 of conductive metal layers disposed on upper and lower surfaces of the piezoelectric plate 4. At least one electrode 15 has a trunk portion 17 extending perpendicularly to the stationary member 13 at a central part of the piezoelectric plate 4, and a plurality of reinforcing ribs 18 extending longitudinally or laterally of the element 12 like branches so that the lateral mode resonance of the piezoelectric fan 10 can be suppressed to thereby increase the blow efficiency of the fan. The reinforcing ribs 18 are formed by providing a plurality of laterally spaced grooves extending from the trunk portion 17 and integral with the upper conductive metal layer 15.

Figure 6A:
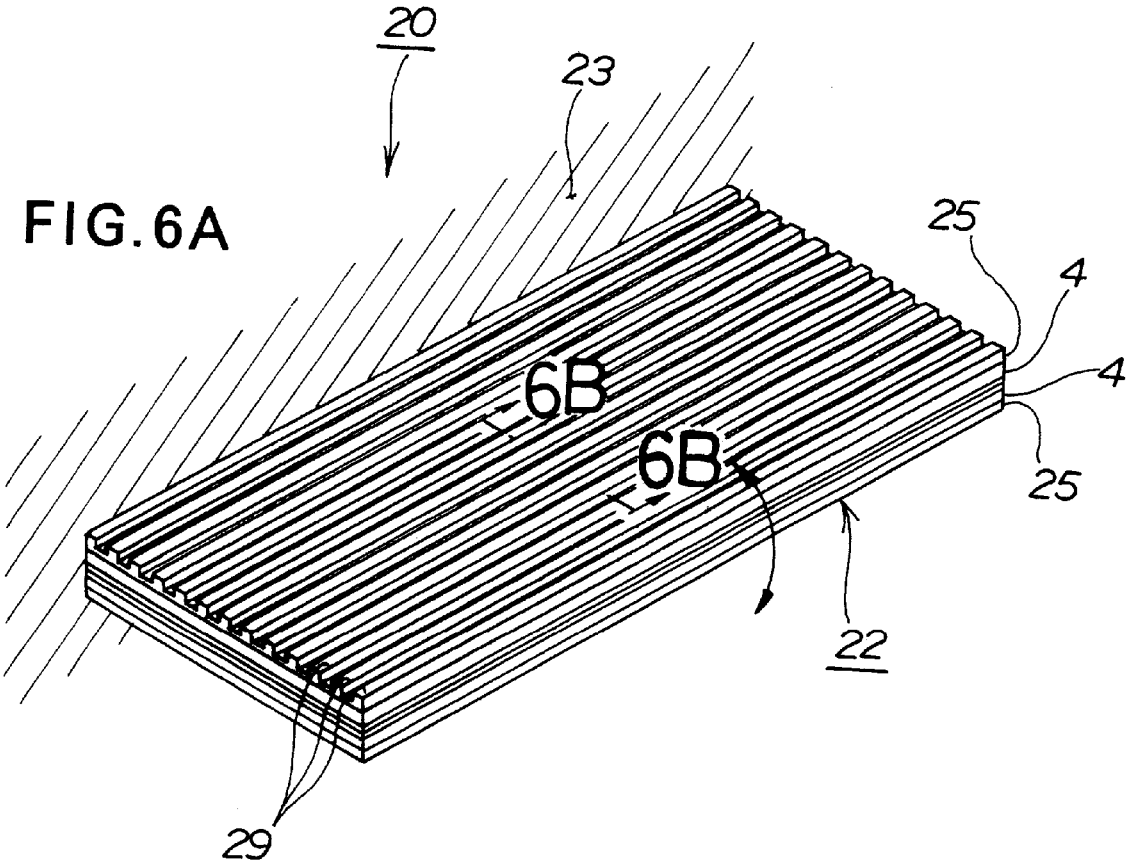
FIG. 6A is a perspective view illustrating a piezoelectric fan according to a third embodiment of the present invention.

Reference is next made to FIG. 6A in which a piezoelectric fan according to a third embodiment of the present invention is shown in perspective. As shown in the figure, the piezoelectric fan 20 has a piezoelectric element 22 fixed at one end to a stationary member 23.

Figure 6B:
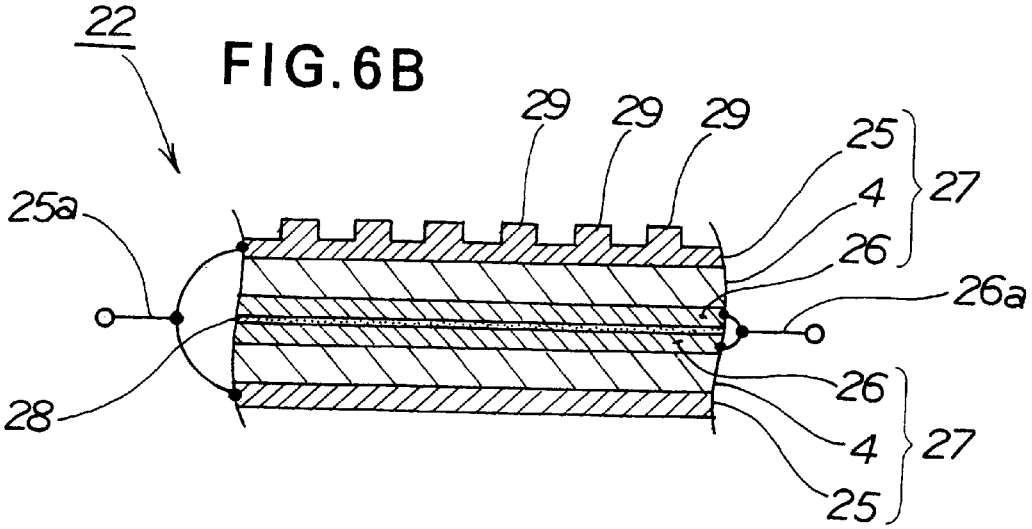
FIG. 6B is a cross-sectional view taken along line 6B—6B of FIG. 6A.

FIG. 6B is a cross-sectional view taken along line 6B—6B of FIG. 6A. The piezoelectric element 22 is comprised of two piezoelectric element units 27 joined together via a bond layer 28, each piezoelectric element unit 27 having a relatively thin piezoelectric plate 4 formed from a piezoelectric material such as PVDF, and electrodes 25, 26 formed of conductive metal layers disposed on upper and lower surfaces of the piezoelectric plate 4. The electrodes 25, 25 of the piezoelectric element units 27, 27 are connected to a common electrode 25*a*. Similarly, the electrodes 26, 26 of the units 27, 27 are connected to a common electrode 26*a*.

Piezoelectric fan 20 of the embodiment just described has a large aspect ratio and employs the piezoelectric element 22 with the dual-layered piezoelectric plate 4. The piezoelectric fan of dual-layered construction 20 generates more winds than the single-layer piezoelectric fans according to the first and second embodiments discussed above.

At least one electrode 25 has a plurality of reinforcing ribs 29 extending longitudinally thereof. Each reinforcing rib 29 is integral with the electrode of conductive metal layer. By virtue of the reinforcing ribs 29, the lateral mode resonance of the piezoelectric fan 20 can be suppressed, thus increasing the wind generation or blow efficiency of the fan.

In the embodiment just described, only the electrode 25 is provided with the reinforcing ribs 29 for suppressing the lateral mode resonance of the piezoelectric fan 20. In the present invention, it is sufficient if lateral rigidity of the electrode is increased by the provision of such ribs. As an alternative, at least one of the electrodes 25, 25 and electrodes 26, 26 may be provided with the trunk portion extending perpendicularly to the stationary member and plural reinforcing ribs extending from the trunk portion like branches longitudinally of the piezoelectric fan, as in the embodiment of FIG. 5A.

Figure 7A:
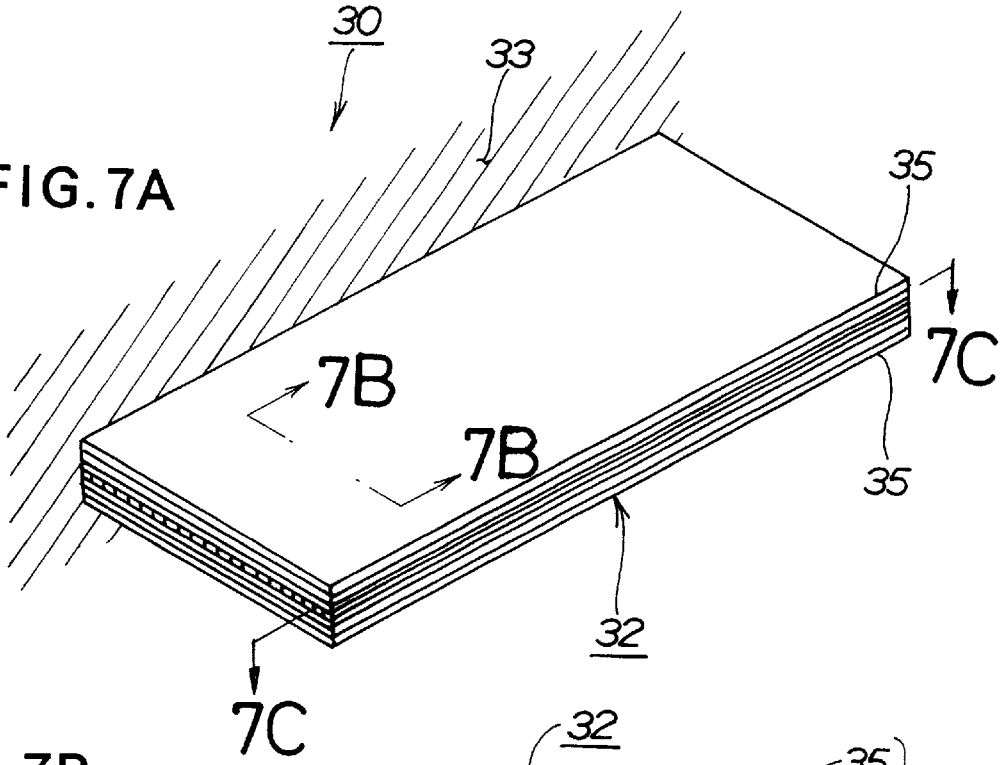
FIG. 7A is a perspective view illustrating a piezoelectric fan according to a fourth embodiment of the present invention.

FIG. 7A illustrates in perspective a piezoelectric fan according to a fourth embodiment of the present invention. As shown, the piezoelectric fan 30 has a piezoelectric element 32 fixed at one end to a stationary member 33.

Figure 7B:
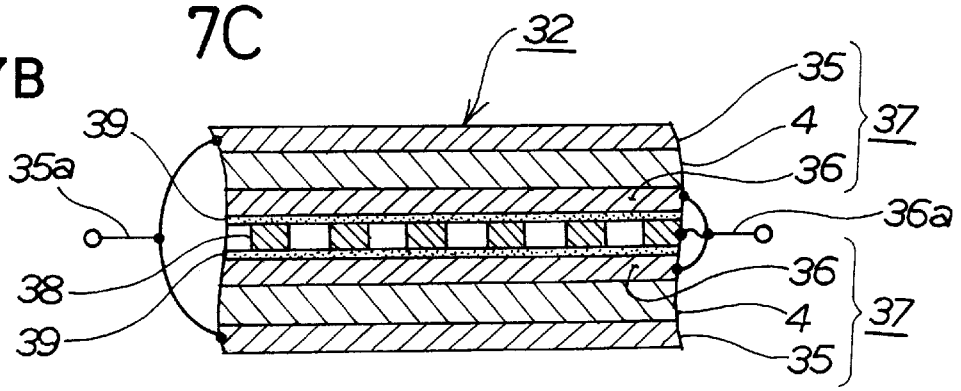
FIG. 7B is an enlarged cross-sectional view taken along line 7B—7B of FIG. 7A.

As shown in FIG. 7B, the piezoelectric element 32 is comprised of two piezoelectric elements 37, 37 each having a relatively thin piezoelectric plate 4 made from a piezoelectric material such as PVDF, and electrodes 35, 36 of conductive metal layers disposed on upper and lower surfaces of the piezoelectric plate 4. Each piezoelectric element 37, 37 has a stiffener 38 of conductive metal layer as a substrate. The electrodes 35, 35 of the piezoelectric elements 37, 37 are connected to a common electrode 35*a*. Similarly, the electrodes 36, 36 are connected to a common electrode 36*a*.

Piezoelectric fan 30 according to the embodiment just described is one of large aspect ratio wherein the piezoelectric plate 4 is dual-layered with the stiffener 38 of a resilient material interposed therebetween.

Stiffener 38 may be made of a reinforcing material such as synthetic resins, in which instance the two electrodes 36, 36 may be connected to a common electrode.

Figure 7C:
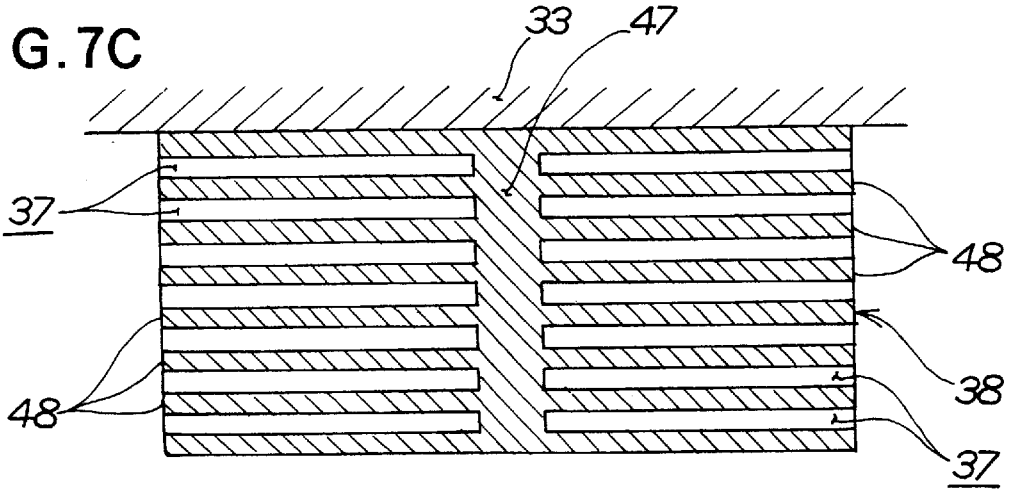
FIG. 7C is an enlarged cross-sectional view taken along line 7C—7C of FIG. 7A.

Referring now to FIG. 7C, the stiffener 38 has a trunk portion 47 extending perpendicularly to the fixing member 33, and a plurality of reinforcing ribs 48 extending from the trunk portion 47 like branches longitudinally of the piezoelectric element 37. With this arrangement, lateral rigidity of the piezoelectric element is increased. As a result, the lateral mode resonance can be suppressed, thus leading to increased blow efficiency of the piezoelectric element. The stiffener 38 having the reinforcing ribs 48 of this embodiment is formed from a separate member independent of the conductive metal layers, unlike the reinforcing ribs of the first, second and third embodiments which are integral with the conductive metal layers. By arranging the reinforcing ribs to be made from a separate member independent of the conductive metal layers, the reinforcing members can be manufactured more easily.

Figure 8:
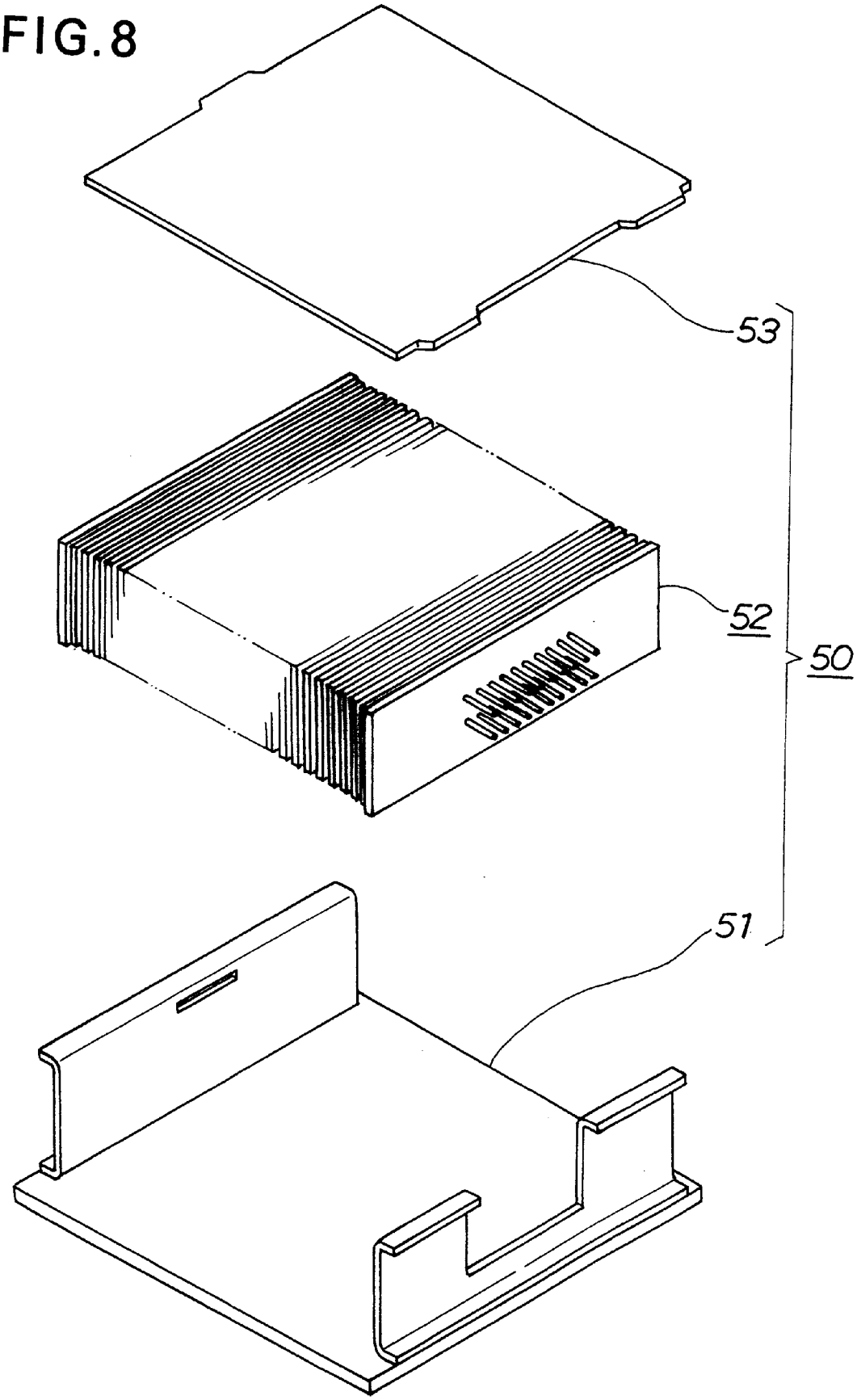
FIG. 8 is an exploded perspective view illustrating a blow apparatus according to the present invention.

Referring to FIG. 8, discussion will be made as to a blow apparatus employing an altered form of the piezoelectric fan according to the embodiment of FIG. 7A to FIG. 7C.

In FIG. 8, there is shown the blow apparatus 50 in exploded perspective. The blow apparatus 50 is comprised of a receptor casing 51, an apparatus body 52 and a cover 53. The apparatus body 52 is received in the receptor casing 51 and enclosed by the cover 53.

Figure 9A:
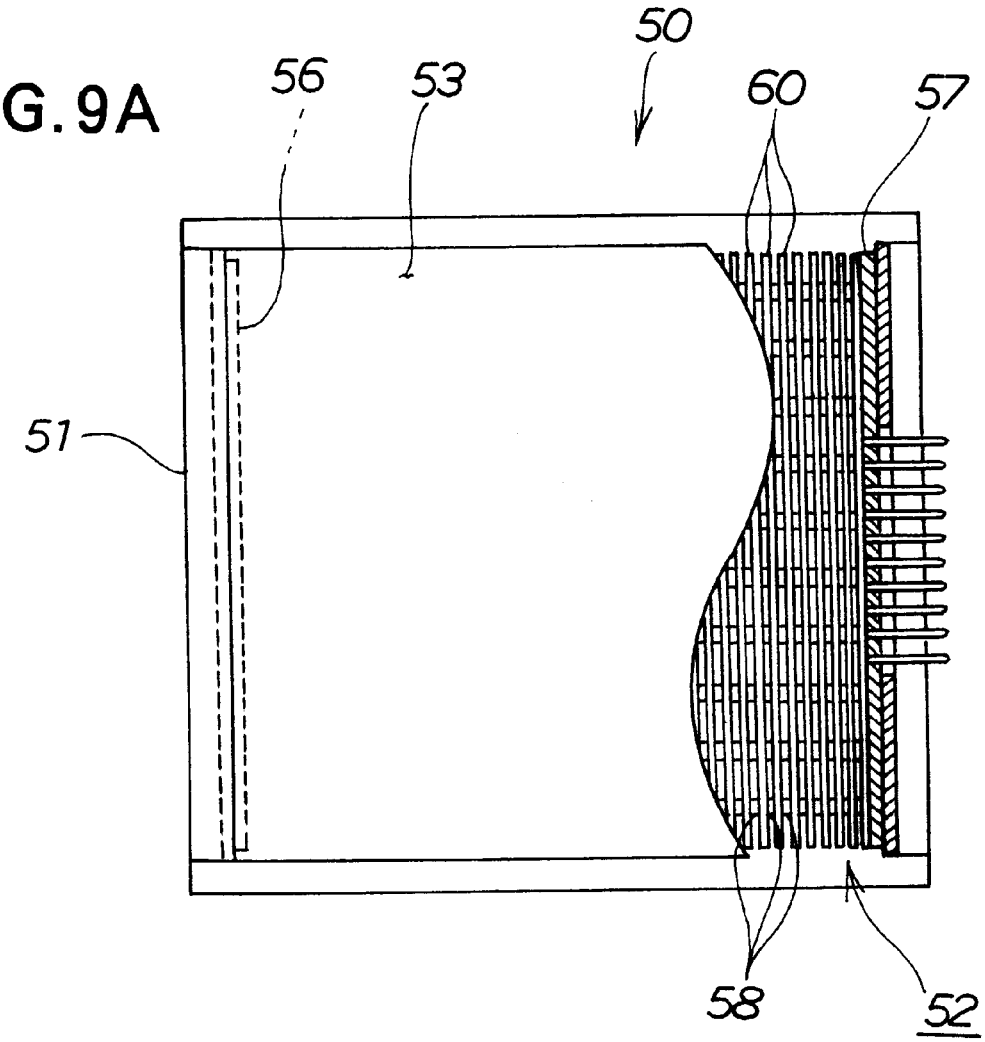
FIG. 9A is a top plan view illustrating the blow apparatus as assembled but with the cover partially cut away.
Figure 9B:
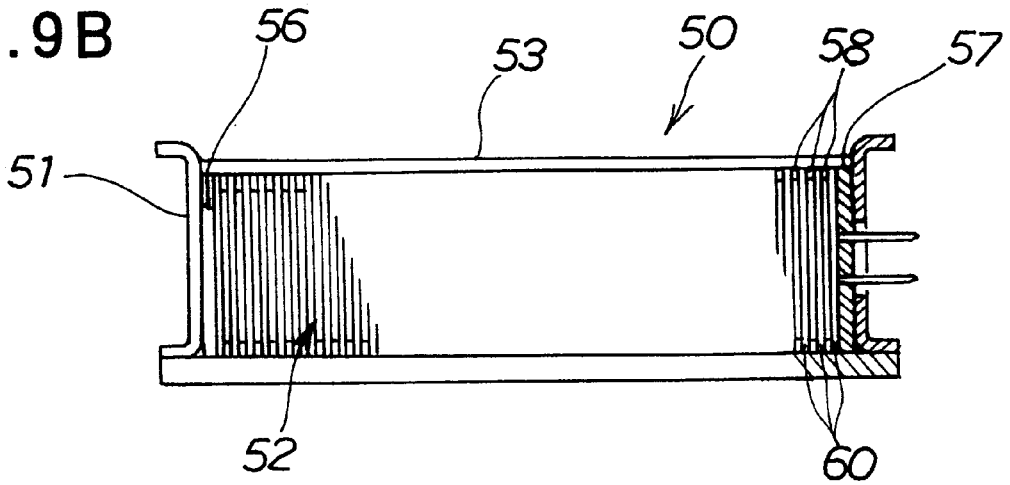
FIG. 9B is a side elevational view, partially cut away, of the blow apparatus.

As shown in FIG. 9A, the apparatus body 52 is comprised of an end plate 56, an end electrode plate 57, a plurality of spacers 58 and a plurality of piezoelectric fan units 60. As shown in FIG. 9B, the plural piezoelectric fan units 60 are disposed between the end plate 56 and end electrode plate 57 via the spacers 58.

Figure 10:
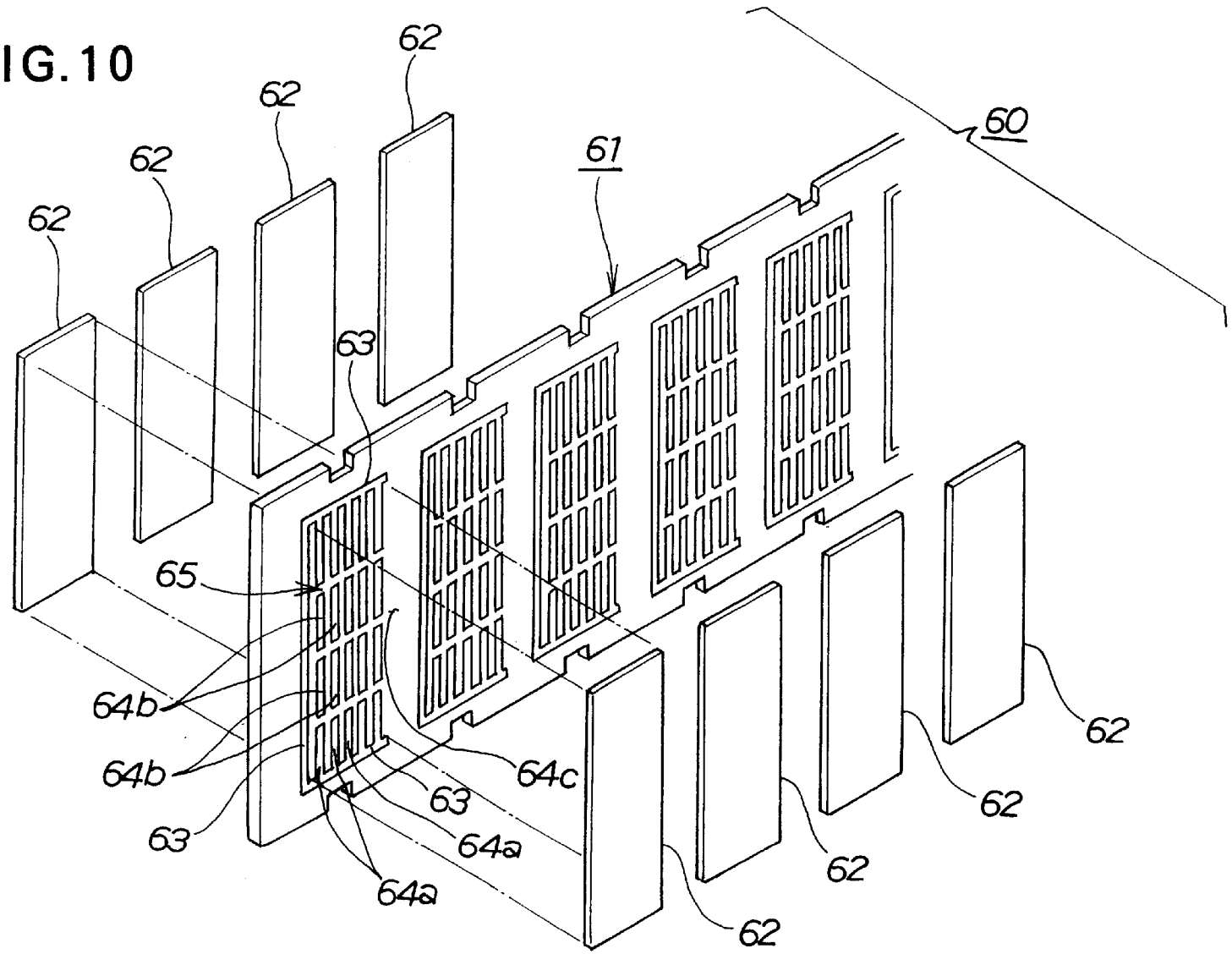
FIG. 10 is an exploded perspective view of a piezoelectric fan unit according to the present invention.

One piezoelectric fan unit 60 is shown in detail in FIG. 10. The piezoelectric fan unit 60 is comprised of a stiffener 61 of conductive metal layer as a substrate and plural piezoelectric elements 62 bonded to both surfaces of the stiffener 61. The piezoelectric elements 62, 62 are provided in pairs at plural locations along the stiffener 61.

Stiffener 61 has a plurality of spaced reinforcing ribs 65. Each reinforcing rib 65 is formed by providing channel-shaped slits 63, cutouts 64*a* communicating with the channel-shaped slits 63, and rectangular holes 64*b* surrounded by the slits 63. Between the reinforcing ribs 65, there is provided a support portion 64*c* serving as the roots of the reinforcing ribs 65 and supporting the same. The support portion 64*c* serves as the stationary members of the first, second, third and fourth embodiments described above. Since the stiffener 61 is provided with the reinforcing ribs 65 through formation of the cutouts 64*a* and rectangular holes 64*b*, the long side direction or lateral mode resonance of the piezoelectric elements 62 can be suppressed, whereby blow efficiency of the unit 60 is increased.

Figure 11:
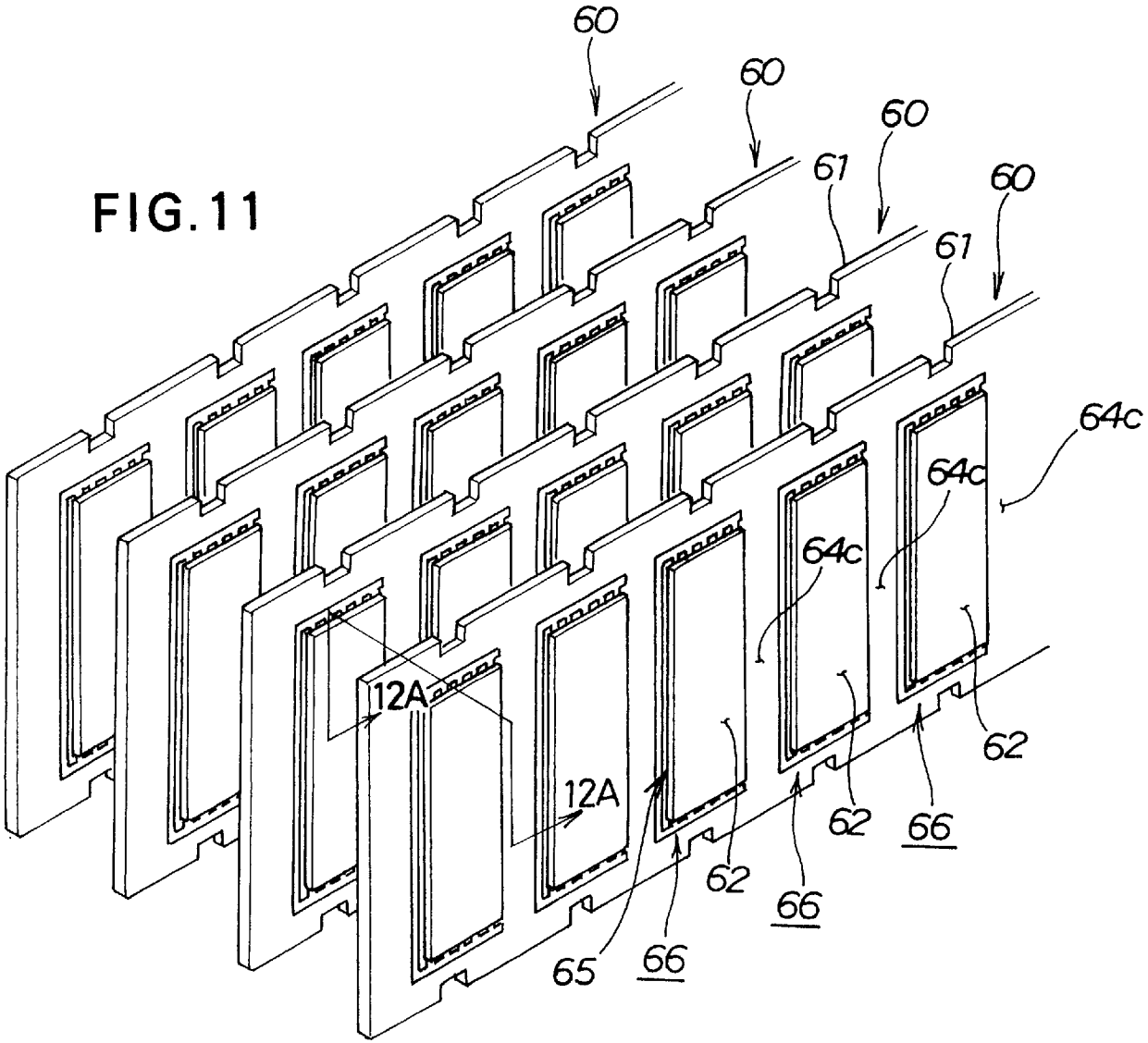
FIG. 11 is a perspective view illustrating a plurality of piezoelectric fan units according to the present invention.

Shown in FIG. 11 are plural piezoelectric fan units 60 in combination. Each piezoelectric fan unit 60 includes plural piezoelectric fans 66. Each piezoelectric fan 66 is supported on a support portion 64*c* of the stiffener 61 and comprised of piezoelectric elements 62 bonded to both surfaces of the reinforcing ribs 65 of the stiffener 61.

Figure 12:
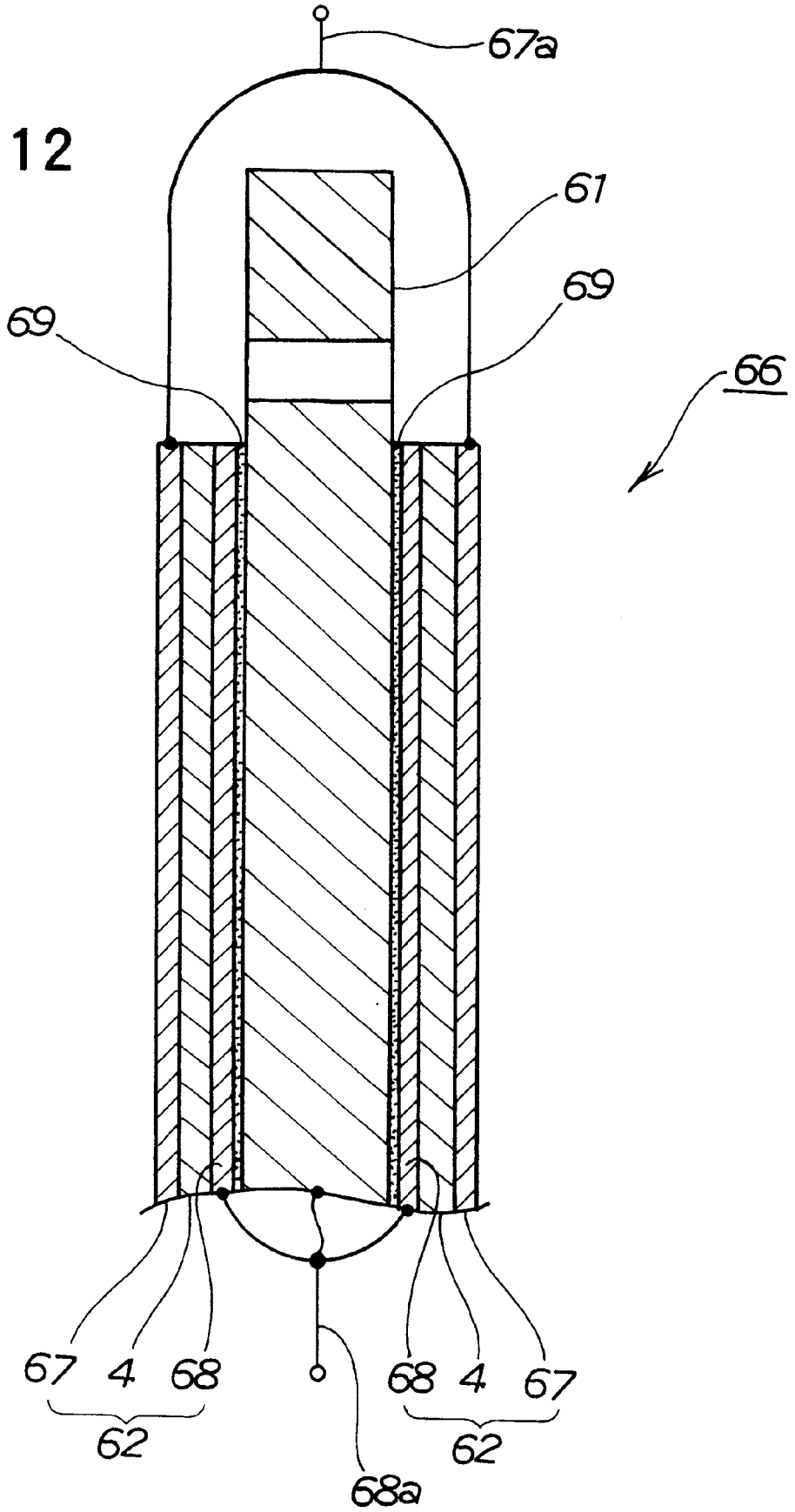
FIG. 12 is an enlarged cross-sectional view taken along line 12A—12A of FIG. 11.

Reference is next had to FIG. 12 which is an enlarged cross-sectional view taken along line 12A—12A of FIG. 11, showing the detailed construction of the piezoelectric fan 66.

Piezoelectric fan 66 has the stiffener 61 as the substrate of conductive metal plate. The piezoelectric elements 62 are bonded to both surfaces of the stiffener 61 through bond layers 69, 69. Each piezoelectric element 62 is comprised of a relatively thin piezoelectric plate 4 made from a piezoelectric material such as PVDF, and electrodes 67, 68 of conductive metal layers formed on both surfaces of the piezoelectric plate 4. Electrodes 67, 67 of the paired piezoelectric elements 62, 62 are connected to a common electrode 67*a*. The other electrodes 68, 68 of the paired elements 62, 62 and the electrode of the stiffener 61 are connected to a common electrode 68*a*. It may be appreciated that the piezoelectric fan arrangement of this embodiment is an application of the piezoelectric fan of sandwich construction according to the fourth embodiment shown in FIG. 7B.

Figure 13:
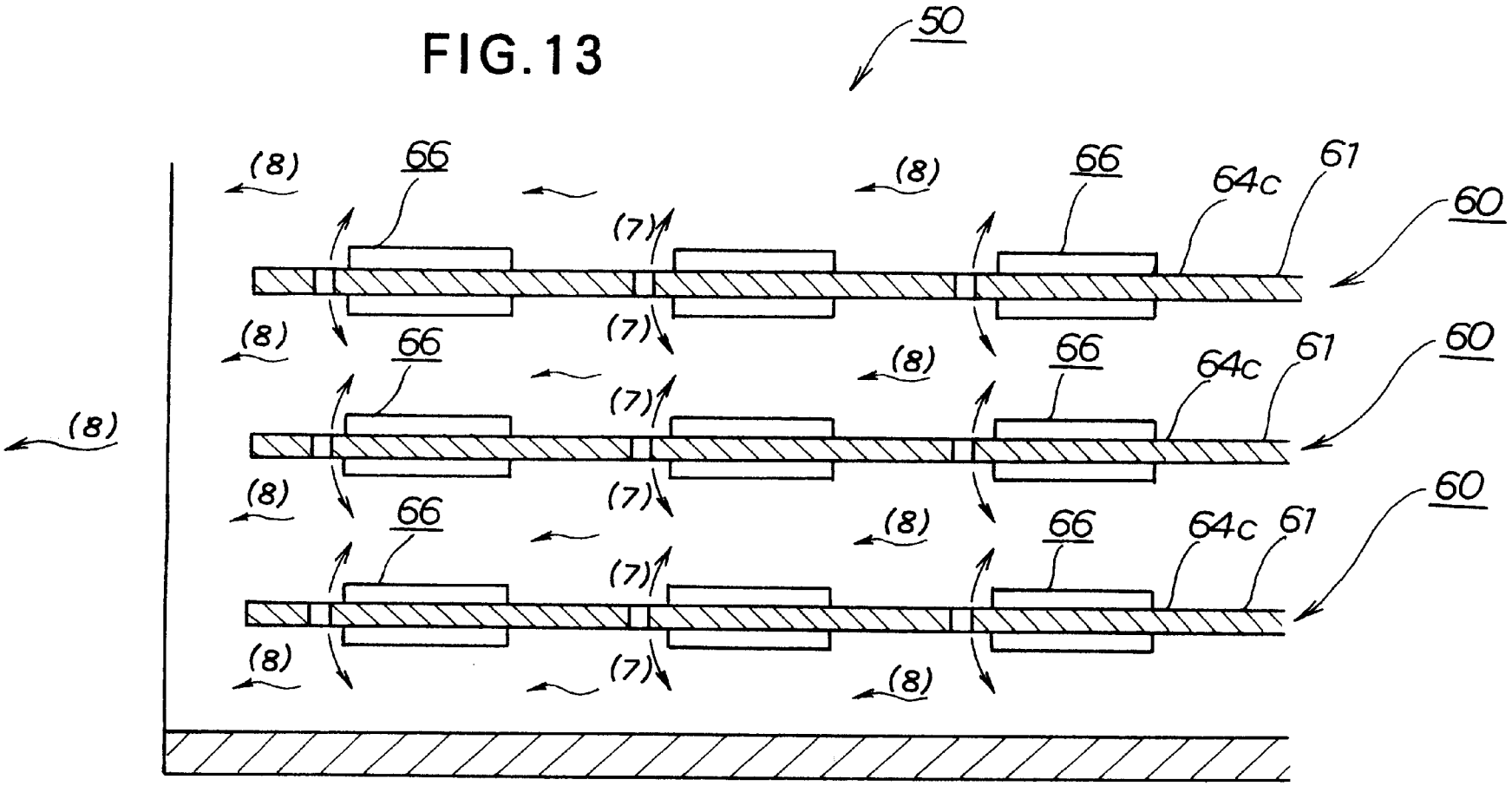
FIG. 13 is a view showing operation of the blow apparatus according to the present invention.
Figure 14:
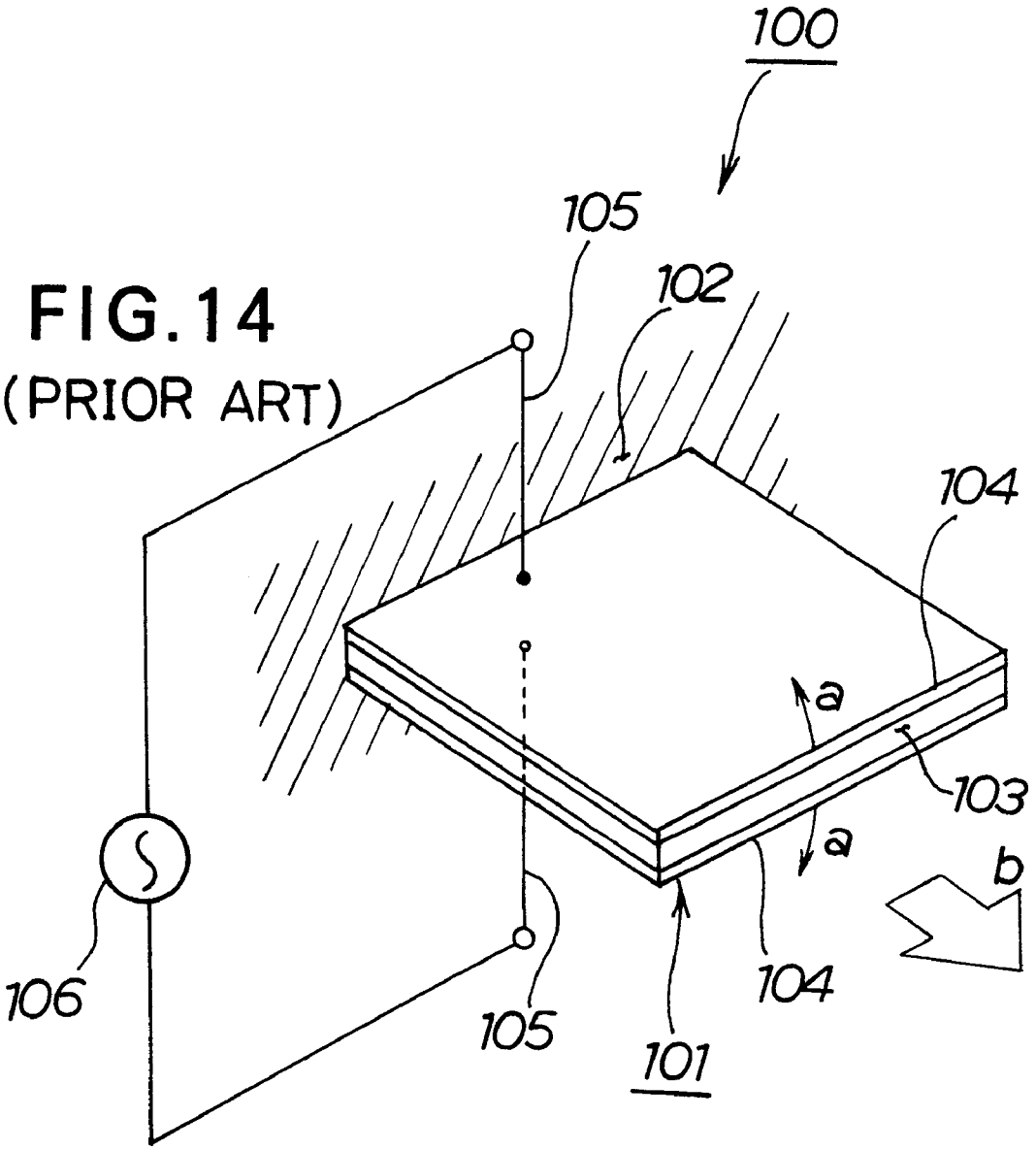
FIG. 14 (PRIOR ART)
FIG. 14 is a schematic view illustrating the principle of operation of a conventional piezoelectric fan employing a piezoelectric element.

Next, operation of the blow apparatus 50 of the above embodiment will be explained having reference to FIG. 13.

When each piezoelectric fan unit 60 is energized, each piezoelectric fan 66 vibrates as shown by arrows (7), (7) with an opposite end held stationary by the support portion 64*c*, whereby a wind blowing in a direction of arrow (8) is generated. Since the blow apparatus 50 thus includes plural piezoelectric fan units 60 each having a multiplicity of piezoelectric fans 66 attached to the stiffener 61, it can generate a sufficient amount of wind.

Although the blow apparatus has been explained as one employing an alteration of the piezoelectric fan according to the fourth embodiment (FIG. 7A), it can be readily appreciated by those skilled in the art that the blow apparatus may also be formed by applying the piezoelectric fans according to the first, second, third and fourth embodiments of the present invention.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A piezoelectric fan comprising at least one piezoelectric element having a substantially rectangular thin plate made from a piezoelectric material, and conductive metal layers as electrodes provided on both surfaces of said thin plate, one of two long sides of said piezoelectric element being fixed to a stationary member, so that when a voltage is applied across said electrodes, said piezoelectric element vibrates to thereby generate a wind, wherein at least one of said conductive metal layers has a plurality of reinforcing ribs extending parallel to said one long side of said piezoelectric element.

2. A piezoelectric fan according to claim 1, wherein said reinforcing ribs are divided into a first group of reinforcing ribs and a second group of reinforcing ribs by a trunk portion extending perpendicularly to said stationary member centrally of said conductive metal layers.

3. A piezoelectric fan according to claim 1, wherein said piezoelectric element comprises two piezoelectric elements, at least one of which has said reinforcing ribs on one of said conductive metal layers thereof, said two piezoelectric elements being bonded together through a bond layer.

4. A piezoelectric fan according to claim 1, wherein said reinforcing ribs are formed integrally with said conductive metal layers.

5. A piezoelectric fan according to claim 1, wherein said reinforcing ribs are formed from a separate member structurally independent of said conductive metal layers.

6. A piezoelectric fan according to claim 5, wherein said reinforcing ribs are divided into a first group of reinforcing ribs and a second group of reinforcing ribs by a central trunk portion extending perpendicularly to said stationary member centrally of said conductive metal layers.

7. A piezoelectric fan according to claim 6, wherein said reinforcing ribs are formed from a conductive metal.

8. A piezoelectric fan according to claim 6, wherein said reinforcing ribs are formed from synthetic resins.

9. A piezoelectric fan according to claim 1, wherein said piezoelectric material of said piezoelectric element is poly vinylidene fluoride.

10. A piezoelectric fan according to claim 1, wherein said piezoelectric element has an aspect ratio of 3.0 or larger.

11. A piezoelectric fan unit comprising at least one substrate having a row of piezoelectric fans disposed thereon at a given interval, each of said fans including at least one piezoelectric element having a generally rectangular thin plate of piezoelectric material and conductive metal layers as electrodes disposed on both surfaces of said thin plate, so that when a voltage is applied across said electrodes, said piezoelectric element vibrates to thereby generate a wind, wherein said substrate has a plurality of reinforcing ribs provided at a corresponding portion thereof where said piezoelectric element is to be positioned and extending parallel to long sides of said piezoelectric element.

12. A piezoelectric fan unit according to claim 11, wherein said reinforcing ribs are formed by providing said substrate with channel-shaped slits so that plural cutouts and rectangular holes extending in parallelism with said long sides are formed at an internal portion surrounded by said slits.

13. A piezoelectric fan unit according to claim 11, wherein said substrate is comprised of said conductive metal layers.

14. A piezoelectric fan unit according to claim 11, wherein said piezoelectric element has an aspect ratio of 3.0 or larger.

15. A blow apparatus comprising:

a fan body including a plurality of piezoelectric fan units arranged in juxtaposition by means of spacers, each of said fan units including a substrate having a row of piezoelectric fans disposed thereon at a given interval, each of said piezoelectric fans including at least one piezoelectric element bonded to plural reinforcing ribs provided on said substrate and extending parallel to long sides of said piezoelectric element, said piezoelectric element having a substantially rectangular thin plate of piezoelectric material and conductive metal layers as electrodes disposed on both surfaces of said thin plate;

a receptor casing for accommodating said fan body; and a cover for enclosing an upper part of said fan body.

16. A blow apparatus according to claim 15, wherein said reinforcing ribs are formed by providing said substrate with channel-shaped slits so that plural cutouts and rectangular holes extending in parallelism with said long sides are formed at an internal portion surrounded by said slits.

* * * * *